US005293182A

United States Patent [19]

Sekiya et al.

[11] Patent Number: 5,293,182

[45] Date of Patent: Mar. 8, 1994

[54] LIQUID JET RECORDING HEAD WITH SELECTED BUBBLE DISAPPEARANCE POSITION

[75] Inventors: Takuro Sekiya; Takashi Kimura; Mitsuru Shingyouchi, all of Yokohama, Japan

[73] Assignee: Ricoh Company, Ltd., Tokyo, Japan

[21] Appl. No.: 833,763

[22] Filed: Feb. 11, 1992

[30] Foreign Application Priority Data

Feb. 13, 1991 [JP] Japan ..... 3-41283

[51] Int. Cl.[5] ..... B41J 2/05

[52] U.S. Cl. ..... 346/140 R

[58] Field of Search ..... 346/140

[56] References Cited

U.S. PATENT DOCUMENTS

| | | | |
|---|---|---|---|
| 4,339,762 | 7/1982 | Shirato | 346/140 |
| 4,514,741 | 4/1985 | Meyer | 346/140 |
| 4,792,818 | 12/1988 | Eldridge | 346/140 |
| 4,914,562 | 4/1990 | Abe | 346/140 |
| 4,947,189 | 8/1990 | Braun | 346/140 |

FOREIGN PATENT DOCUMENTS

| | | | |
|---|---|---|---|
| 0051837 | 4/1979 | Japan | B41J 3/04 |
| 0095155 | 6/1984 | Japan | B41J 3/04 |
| 0034506 | 8/1984 | Japan | B41J 3/04 |
| 208246 | 10/1985 | Japan . | |
| 0236758 | 11/1985 | Japan | B41J 3/04 |
| 0103148 | 5/1987 | Japan | B41J 3/04 |
| 0025337 | 1/1990 | Japan | B41J 3/04 |

*Primary Examiner*—Joseph W. Hartary
*Attorney, Agent, or Firm*—Cooper & Dunham

[57] ABSTRACT

A liquid jet recording head includes a heater element which comprises a heat reserve layer, a resistance layer formed on the heat reserve layer, electrodes electrically connected to the resistance layer, the resistance layer generating heat when an electrical current is supplied to the resistance layer via the electrodes, and a protection layer stacked on the resistance layer, the heat generated by the resistance layer being transmitted to the liquid via the protection layer. The heater element has a special part in which a width of the resistance layer is greater than that thereof in a normal part of the heater element, the special part including a position where the bubble disappears, so that a electric current density in the resistance layer in the special part is less than that thereof in the normal part.

4 Claims, 11 Drawing Sheets

LIQUID JET RECORDING HEAD WITH SELECTED BUBBLE DISAPPEARANCE POSITION

BACKGROUND OF THE INVENTION (1) Field of the invention

The present invention generally relates to a liquid jet recording head, and more particularly to a liquid jet recording head from which a liquid drop is jetted by a force generated by a growth of a bubble in a liquid. When an amount of heat energy is supplied to the liquid, the liquid boils and the bubble is generated in the liquid.

(2) Description of related art

In this type of the liquid jet recording head, it is required that responsiveness in a high-speed driving operation be good, that the liquid can be efficiently heated to boiling, and that a durability of the recording head be good. Due to these requirements, material and structure of conventional liquid jet recording head have been improved recently.

In a liquid jet recording head disclosed in Japanese Patent Publication No. 59-34506, an electricity-heat converter constructed of three layers, a bottom layer, a heating resistance layer and a top layer are stacked, to improve the responsiveness and heating property of each electricity-heat converter. In the liquid jet recording head disclosed in Japanese Patent Laid Open Publication No. 60-236758, a thin protection layer is stacked on a heater layer so as to improve the durability.

While the generation of the bubble (main bubble or primary bubble) causing liquid drops to be jetted and the disappearance thereof are repeated sequentially on the heater layer, the following phenomenon, in which a secondary bubble remains on an area of the heater layer, can occur. That is, when an area other than an area on which the main bubble disappears has a temperature greater than a predetermined limit temperature, an elongate secondary bubble extending in a direction in which the liquid flows remains on the area. As a cavitation force of a secondary bubble is greater than that of a main bubble, the heater layer can be damaged by the cavitation force of the secondary bubble. As a result, the durability of the liquid jet recording head deteriorates.

To prevent durability from being affected by the secondary bubble, Japanese Patent Laid Open Publication No. 62-103148 discloses a liquid jet recording head having the following structure. This structure of the liquid jet recording head has been proposed based on a phenomenon in which a center temperature of a heat operation part of the electricity-heat converter is higher than that of a surrounding part thereof in a case where the top and bottom layer of the electricity-heat converter have a constant thickness. That is, the thickness of either the top or bottom layer at the center of the heater operation part is less than that of the layer at the surrounding part thereof so that the center of the heater operation part effectively radiates heat. Thus, the temperature is uniformly distributed on the heater operation part when the heater operation part is activated, and the temperature at a center of the heater operation part is less than the limit temperature when the main bubble disappears due to inactivity of the heater operation part.

In a liquid jet recording head disclosed in Japanese Patent Laid Open Publication No. 59-95155, a conductive member is provided at a center of the electricity-heat converter (a resistance layer) so that no bubble is generated thereon. As a result, the center of the electricity-heat converter is prevented from being damaged by cavitation force. In this case, a ring shaped bubble is grown on a circumference of the electricity-heat converter, and a plurality of small bubbles are distributed, at random, on the heater operation part of the electricity-heat converter.

It is further required for this type of the liquid jet recording head to have a high reproducibility of boiling of the liquid.

In a case where the liquid is repeatedly boiled, when the bubble disappears, small residual bubbles adheres to the surface on the heater operation part of the electricity-heat converter at a position where the bubble has disappeared. Then, when a bubble starts to be generated in a next heat cycle of the electricity-heat converter, the small residual bubbles become a core of the bubble growth. This core is referred to as a bubble core. In a case where a bubble core appears on the surface of the heater operation part, the bubble is prevented from growing normally. That is, high reproducibility of the bubble in the liquid can not be guaranteed. When the reproducibility of the bubble in the liquid decreases, a size of the liquid drop, a jetting speed thereof and the like are varied, so that a quality of the dot images formed on the recording sheet deteriorates.

Japanese Patent Laid Open No. 2-25337 discloses a liquid jet recording head in which the small residual bubbles are prevented from becoming the growing core of the bubble in the next heating cycle of the electricity-heat converter. The residual bubbles are generated on the heater operation part of the electricity-heat converter at the position where the bubble disappears. Thus, when the electricity-heat converter is activated, the temperature of the heater operation part at the position where the bubble disappears is less than that at other positions on the heater operation part. As a result, even if small residual bubbles are generated on the heater operation part at the position where the bubble disappears, the small residual bubbles do not become the growing core of the bubble in the next heating cycle of the electricity-heat converter.

In the liquid jet recording head disclosed in Japanese Patent Laid Open No. 2-25337, the thickness of a heat reserve layer, on which the heating resistance layer is formed, in a part including the position where the bubble disappears is decreased. Due to this structure, the temperature of the part including the position where the bubble disappears can be decreased when the bubble disappears.

However, in the conventional liquid jet recording head, it is difficult to actually form the heat reserve layer in which the thickness thereof varies between the substrate and the heating resistance layer.

SUMMARY OF THE INVENTION

Accordingly, a general object of the present invention is to provide a novel and useful liquid jet recording head in which the disadvantages of the aforementioned prior art are eliminated.

A more specific object of the present invention is to provide a liquid jet recording head in which the liquid droplet can be stably jetted.

Another object of the present invention is to provide a liquid jet recording head capable of easily being manufactured.

The above objects of the present invention are achieved by a liquid jet recording head comprising: liquid storage means for storing a liquid used for recording images; and heater means, coupled to the liquid storage means, for generating heat, generation of a bubble and disappearance thereof being alternately carried out in the liquid stored in the liquid storage means when the heater means is activated and inactivated alternately, and a liquid droplet being jetted from the liquid storage means by a propulsion force of the bubble, the heater means comprising: a heat reserve layer; a resistance layer formed on the heat reserve layer; electrodes electrically connected to the resistance layer, the resistance layer generating heat when an electrical current is supplied to the resistance layer via the electrodes; and a protection layer stacked on the resistance layer, the heat generated by the resistance layer being transmitted to the liquid via the protection layer; wherein the heater means has a special part in which a width of the resistance layer is greater than that thereof in a normal part of the heater means, the special part including a position where the bubble disappears, so that a electric current density in the resistance layer in the special part is less than that thereof in the normal part.

The above objects of the present invention are also achieved by a liquid jet recording head comprising: liquid storage means for storing a liquid used for recording images; and heater means, coupled to the liquid storage means, for generating heat, generation of a bubble and disappearance thereof being alternately carried out in the liquid stored in the liquid storage means when the heater means is activated and inactivated alternately, and a liquid droplet being jetted from the liquid storage means by a propulsion force of the bubble, the heater means comprising: a heat reserve layer; a resistance layer formed on the heat reserve layer; electrodes electrically connected to the resistance layer, the resistance layer generating heat when an electrical current is supplied to the resistance layer via the electrodes; and a protection layer stacked on the resistance layer, the heat generated by the resistance layer being transmitted to the liquid via the protection layer; wherein the heater means has a special part in which a thickness of the resistance layer is greater than that thereof in a normal part of the heater means, the special part including a position where the bubble disappears, so that a electric current density in the resistance layer in the special part is less than that thereof in the normal part.

The above object of the present invention are also achieved by a liquid jet recording head comprising: liquid storage means for storing a liquid used for recording images; and heater means, coupled to the liquid storage means, for generating heat, generation of a bubble and disappearance thereof being alternately carried out in the liquid stored in the liquid storage means when the heater means is activated and inactivated alternately, and a liquid droplet being jetted from the liquid storage means by a propulsion force of the bubble, the heater means comprising: a heat reserve layer; a resistance layer formed on the heat reserve layer; electrodes electrically connected to the resistance layer, the resistance layer generating heat when an electrical current is supplied to the resistance layer via the electrodes; and a protection layer stacked on the resistance layer, the heat generated by the resistance layer being transmitted to the liquid via the protection layer; wherein the heater means has a special part in which a conductive member is formed on the resistance layer, the special part including a position where the bubble disappears, so that a electric current density in the resistance layer in the special part is less than that thereof in the normal part.

The above object of the present invention are also achieved by a liquid jet recording head comprising: liquid storage means for storing a liquid used for recording images; and heater means, coupled to the liquid storage means, for generating heat, generation of a bubble and disappearance thereof being alternately carried out in the liquid stored in the liquid storage means when the heater means is activated and inactivated alternately, and a liquid droplet being jetted from the liquid storage means by a propulsion force of the bubble, the heater means comprising: a heat reserve layer; a resistance layer formed on the heat reserve layer; electrodes electrically connected to the resistance layer, the resistance layer generating heat when an electrical current is supplied to the resistance layer via the electrodes; and a protection layer stacked on the resistance layer, the heat generated by the resistance layer being transmitted to the liquid via the protection layer; wherein the heater means has a special part in which a radiator member is provided on the protection layer, the special part including a position where the bubble disappear, so that special part is cooled by the radiator member.

According to the present invention, the surface temperature of the special part of the heater means is less than that of normal part of the heater means. Thus, even if small bubbles remains in the special part of the heater means, the residual small bubbles are not a core of the boiling in the next heat cycle of the heater means.

Additional objects, features and advantages of the present invention will become apparent from the following detailed description when read in conjunction with the accompanying drawings.

DESCRIPTION OF THE PREFERRED EMBODIMENTS

A description will now be given on a first embodiment of the present invention with reference to FIGS. 1A through 4.

Figure 1A:
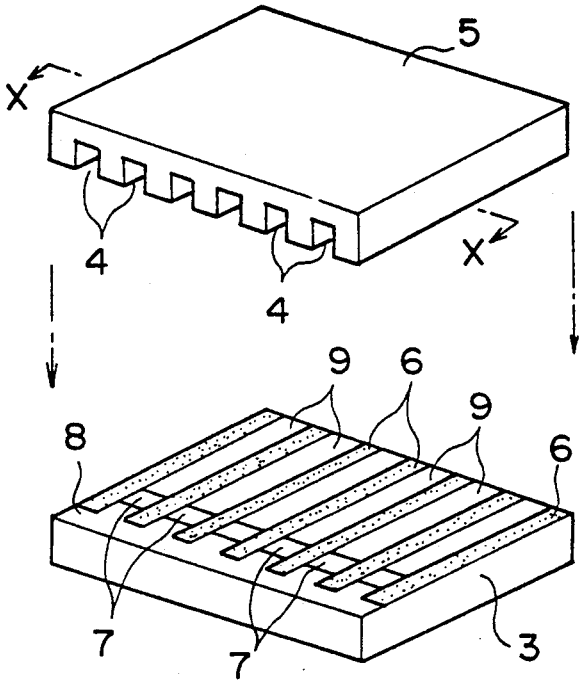
FIG. 1A is a diagram illustrating a liquid jet recording head.
Figure 1B:
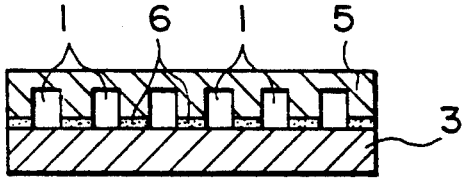
FIG. 1B is a cross sectional view taken along line X—X shown in FIG. 1A.
Figure 2:
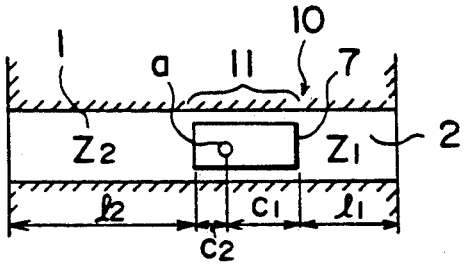
FIG. 2 is a diagram illustrating a position where the bubble disappears.

FIG. 1A is an essential part of a liquid jet recording head according to a first embodiment of the present invention. FIG. 1B is a cross sectional view taken along line X—X shown in FIG. 1A. FIG. 2 shows a structure of each flow path formed in the liquid jet recording head shown in FIGS. 1A and 1B. Referring to FIGS. 1A, 1B and 2, a plurality of heating resistance layers 7 are formed on a substrate 3 so as to be arranged in a line. A common electrode 8 and selection electrodes 9 are also formed on the substrate 3 so that each of the heating resistance layers 7 is sandwiched by the common electrode 8 and a corresponding one of the selection electrodes 9. A plurality of grooves 4 are formed on a plate 5 so as to be arranged in parallel to each other. Each of the grooves 4 corresponds to one of the heating resistance layers 7 formed on the substrate 3. The plate 5 is adhered to the substrate 3 by adhesion layers 6 so that each of the grooves 4 faces a corresponding one of the heating resistance layers 7. In a state where the plate 5 is adhered to the substrate 3, a flow path 1 is formed between each of the grooves 4 and the substrate 3. Each of the heating resistance layer 7, the corresponding one of the selection electrodes 9 and the common electrode 8 form an electricity-heat conversion element 10. That is, the electricity-heat conversion element 10 is mounted in each flow path 1. A portion between the common electrode 8 and each of the selection electrodes 9 operates as a heater operation part 11 for supplying heat to the liquid in the flow path 1.

A liquid supplier (not shown) supplies liquid (e.g. ink) to each flow path 1 of the liquid jet recording head via a liquid chamber (not shown). When the electric power is supplied to each electricity-heat conversion element 10, the liquid on each of the heater operation part 11 of the electricity-heat conversion element 10 is heated thereby so that a bubble is instantly generated and grown. Then a liquid droplet is jetted through an orifice 2, at a front end of each flow path 1, by a propulsion force cased by the growth of the bubble.

A disappearance position is defined as a position on the heater operation part 11 of the electricity-heat conversion element 10, where the bubble disappears. In the embodiment, a current density in a part of heating resistance layer 7 corresponding to the disappearance position is decreased, so that an amount of heat generated from the heater operation part 10 at the disappearance position decreases.

The disappearance position is calculated as follows.

The disappearance position depends on a shape of the flow path 1, an arrangement of the heater operation part 11 in the flow path 1, a temperature of the liquid in the flow path 1, and other environmental conditions. An inertia component Z of a hydrodinamic impedance in a flow area surrounding the bubble affects the disappearance position. That is, it can be assumed that the disappearance position is a position at which the length of the heater operation part 11 in a flow direction of the liquid is divided based on a reciprocal ratio of the inertia component Z of the hydrodinamic impedance.

The inertia component Z of the hydrodinamic impedance in the flow area can be calculated in accordance with the following formula (1):

$$Z = \int_{o}^{l} [\rho/S(x)]dx \quad (1)$$

where x is a position in the flow path of the liquid, S(x) is a cross sectional area of the flow path 1 at the position x, 1 is a length of the flow area, and $\rho$ is a density of the liquid.

In a case where the liquid droplet is jetted in a direction in which the liquid is supplied to the heating resistance layer 7 as shown in FIGS. 1A and 1B, if the cross sectional area S of the flow path is constant (S(x) =S), as shown in FIG. 2, inertia components $Z_1$ and $Z_2$ of the hydrodinamic impedance in flow areas at both sides of the heater operation part 11 are expressed by the following formulas (2).

$$Z_1=\rho\cdot l_1/S,\ Z_2=\rho\cdot l_2/S \quad (2)$$

Then, the bubble disappears near a point (a) (the disappearance point) which is defined based on $Z_1$, $Z_2$, $l_1$, $l_2$, $C_1$, and $C_2$ having the following relationships of proportion:

$$C_1 : C_2 = Z_2 : Z_1 = l_2 : l_1$$

where $C_1$ is a distance between a front end of the heater operation part 11 and the disappearance point (a), $C_2$ is a distance between a rear end of the heater operation part 11 and the disappearance point (a), $l_1$ is a distance between a front end (the orifice 2) of the flow path 1 and the front end of the heater operation part 11, and $l_2$ is a distance between a rear end of the flow path 1 and the rear end of the heater operation part 1. At an area including the disappearance position as defined above, various conditions in which the heat flux transmitted to the liquid is small are decided.

The $C_1$ and $C_2$ may be calculated, simply, based on the following relationship of proposion.

$$C_1 : C_2 = w_2 : w_1$$

where $w_1$ is a volume of a space laying between the front end of the flow path 1 and the front end of the heater operation part 11, and $w_2$ is a volume of a space laying between the rear end of the flow path 1 and the rear end of the heater operation part 11. The $w_1$ and $w_2$ are calculated in accordance with the following formulas (3):

$$w_1 = \int_o^{l_1} [1/h(x)]dx, \; w_2 = \int_o^{l_2} [1/h(x)]dx$$

where h(x) is a height of the flow path 1 at position x.

A description will now be given of a condition of a temperature difference between the area corresponding to the disappearance point and a surrounding area, in which condition the liquid droplets can be stably jetted from the flow path 1 via the orifice 2.

Figure 3:
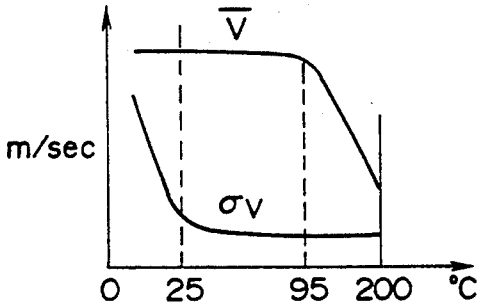
FIG. 3 is a graph illustrating a characteristic of a jetted liquid droplet under a temperature condition.

FIG. 3 shows graphs illustrating a relationship between the temperature difference $\Delta T$ and an average speed $\overline{V}$ at which the liquid droplets are jetted, and a relationship between the temperature difference $\Delta T$ and a standard deviation $\sigma V$ of the jetting speed of the liquid droplets. The temperature difference $\Delta T$ is defined by the equation below :

$$\Delta T = T_H - T_o$$

where $T_H$ is a peak of the surface temperature on the whole heater operation part 11, and $T_o$ is a peak of the surface temperature on a part of the heater operation part 11 corresponding to an area of current density decrease, of the heating resistance layer 7. The temperature difference $\Delta T$ is measured under a condition in which there in no liquid in the flow path 1. In FIG. 3, when the difference temperature $\Delta T$ is equal to or greater than 25° C., the standard deviation $\sigma V$ is maintained at an approximately constant value. That is, a variation of the jetting speed of the liquid droplets is in a stable range. When the temperature difference $\Delta T$ is greater than 95° C., the average of the jetting speed of the liquid droplets is decreased. Thus, it is preferable that the temperature difference $\Delta T$ falls within a range of 25°-95° C.

In a case where the standard deviation $\sigma V$ can be ignored in some measure so that the average $\overline{V}$ of the jetting speed is the mainly consideration, it is preferable that the temperature difference $\Delta T$ falls within a range of 25°-60° C. On the other hand, in a case where average $\overline{V}$ of the jetting speed can be ignored in some measure so that the standard deviation $\sigma V$ of the jetting speed is the main consideration, it is preferable that the temperature difference $\Delta T$ falls within a rage of 30°-95° C. Thus, it is most preferable that the temperature difference falls within a range of 30°-60° C.

In the first embodiment, a width of a pattern of the heating resistance layer 7 is increased on the area including the disappearance position, so that the current density decreases in the area including the disappearance position. That is, an amount of heat generated from the area including the disappearance position is decreased.

Figure 4:
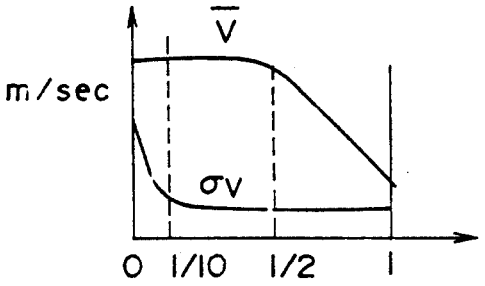
FIG. 4 is a graph illustrating a characteristic of a jetted liquid droplet under a condition of a area ratio between a special part and a normal part of the heat operation part.

FIG. 4 shows graphs illustrating a relationship between a ratio $S_o/S_H$ and an average speed $\overline{V}$ at which the liquid droplets are jetted, and a relationship between the ratio $S_o/S_H$ and a standard deviation $\sigma V$ of the jetting speed of the liquid droplets, where $S_o$ is an area on the heating resistance layer 7 in which the the current density is small, and $S_H$ is a total area of the heating resistance layer generating heat. In FIG. 4, when the ratio $S_o/S_H$ falls within a range 1/10-½, the average $\overline{V}$ of the jetting speed and the standard deviation $\sigma V$ thereof are stable, so that a characteristic in which the liquid is jetted becomes optimal. In a case where the standard deviation $\sigma V$ of the jetting speed of the liquid is ignored in some measure so that the average $\overline{V}$ thereof is the main consideration, it is preferable that the ratio $S_o/S_H$ fall within a range of 1/10-¼. On the other hand, in a case where the average $\overline{V}$ of the jetted speed of the liquid is ignored in some measure so that the standard deviation $\sigma V$ thereof is the main consideration, it is preferable that the ratio $S_o/S_H$ falls within a range of ⅛-½. Thus, it is most preferable that the ratio falls within a range of ⅛-¼.

Figure 5A:
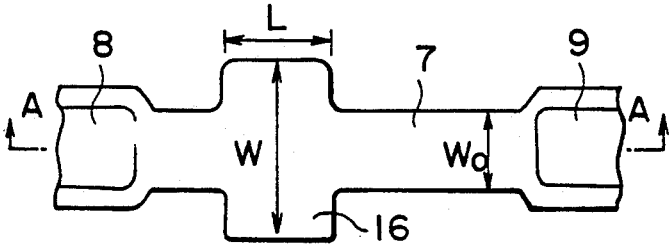
FIGS. 5A and 5B are diagrams illustrating an electricity-heat converter used in the liquid jet recording head according to a first embodiment of the present invention.
Figure 5B:
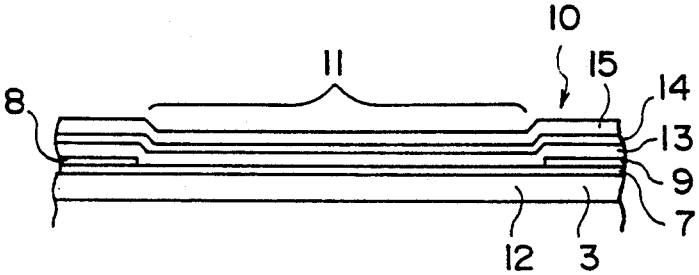
Figure 6:
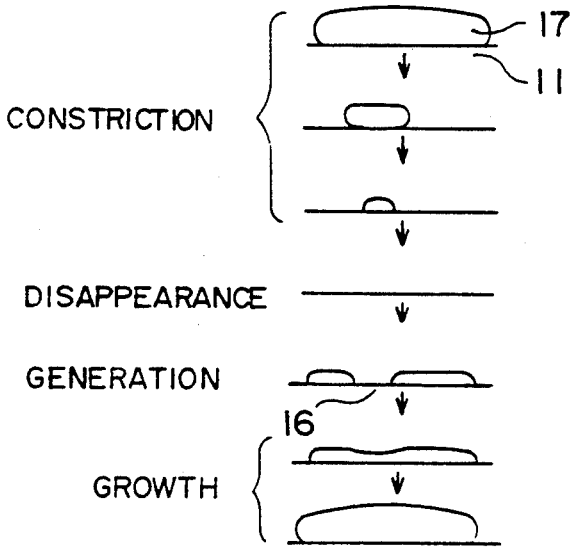
FIG. 6 is a diagram illustrating a variation of the bubble in a process for jetting a liquid droplet.
Figure 7:
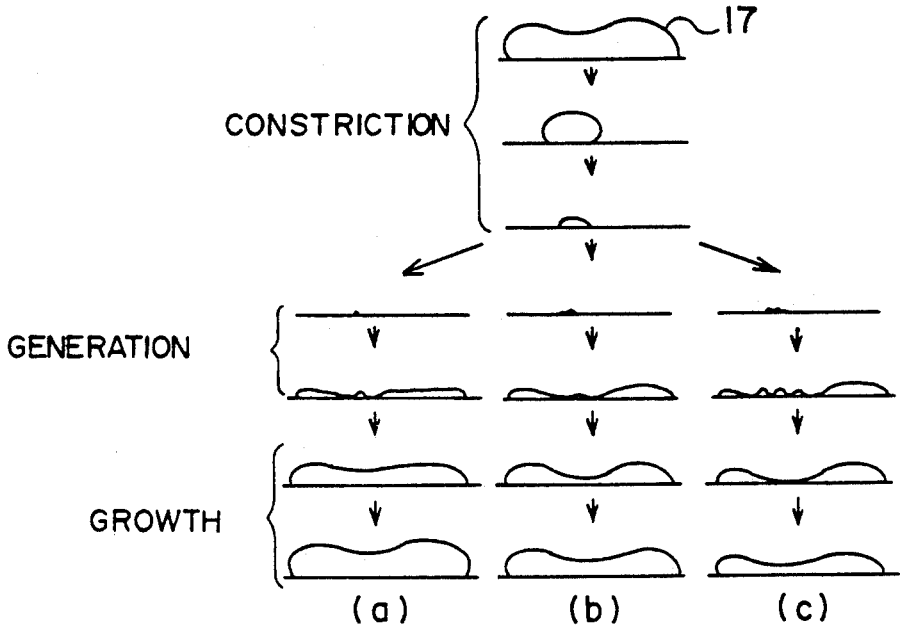
FIG. 7 is a diagram illustrating a conventional variation of the bubble in a process for jetting a liquid droplet.

A description will now be given of a structure of the liquid jet recording head according to the first embodiment with reference to FIGS. 5 through 7. In FIGS. 5A through 7, those parts which are the same as those shown in FIGS. 1 through 4 are given the same reference numbers.

FIG. 5A is a plane view of the electricity-heat conversion element provided in each flow path 1. FIG. 5B is a cross sectional view taken along line A—A shown in FIG. 5A. Referring to FIGS. 5A and 5B, the substrate 3 is formed of Si and has a thickness of 500 μm. A heat reserve layer 12 is formed on the substrate 3. The heating resistance layer 7, the common electrode 8, the selection electrode 9, and protection layers 13, 14, and 15 are stacked on the heat reserve layer 12, so that the electricity-heat conversion element 10 is formed on the substrate 3. In the electricity-heat conversion element 10, the heat operation part 11 is formed between the common electrode 8 and the selection electrode 9.

A surface layer of the Si substrate 3 is oxidized, so that the heat reserve layer 12 made of $SiO_2$ is formed on the substrate 3. The heat reserve layer 12 is, for example, 1.6 μm thick. The heating resistance layer 7 made of $HfB_2$ is deposited on the heat reserve layer 12 by a sputtering process. The heating resistance layer 7 is, for example, 0.15 μm thick. The heater operation part 11 of the electricity-heat conversion element 10 has a length of, for example, 160 μm in a direction of flow of the liquid. The heater operation part 11 has a normal part and a special part 16. The special part 16 includes the disappearance position which is decided as shown in FIG. 3. The special part 16 has a width W greater than a width $W_o$ of the normal part, so that the current density in the special part 16 is greater than that in the normal part. The width $W_o$ of the normal part is, for example, 26 μm. The common electrode 8 and the selection electrode 9, which are made of Al, are deposited to a thickness of 0.8 μm on the heating resistance layer 7 by an EB evaporation method. A first protection layer 13 made of $SiO_2$ is formed by the sputtering process and is, for example, 1.2 μm in thickness. A second protection layer 14 made of $Ta_2O_5$ is formed on the first protection layer 13 by the sputtering process and is, for example, 0.12 μm in thickness. A third protection layer 15 made of Ta is formed on the second protection layer 14 and by the sputtering process and is, for example, 0.4 μm thick.

In the electricity-heat conversion element having a structure shown in FIGS. 5A and 5B, when a width of the special part 16 was varied and the electrical current flowed, in the electricity-heat conversion element 10, under a condition where there was no liquid in the flow path 1, the temperature difference $\Delta T$ corresponding to the width of the special part 16 was obtained as indicated in the following Table. In this case, the temperature difference is a difference between a peak temperature $T_H$ on the normal part and a peak temperature $T_o$ on the special part. Note that the special part 16 had a length L of 30 μm in the flow direction of the liquid.

TABLE

| W (μm) | ΔT (°C.) |
|---|---|
| 50 | 180 |
| 40 | 95 |
| 34 | 50 |
| 30 | 25 |
| 26 | 0 |

According to the above Table, it is preferable that the width W of the special part 16 is within a range of 30 μm–40 μm. When the width W of the special part 16 is 34 μm and the length L thereof is 30 um, the area $S_o=34\times30$ ($\mu m^2$) and the area $S_H=26\times160$ ($\mu m^2$). In this case, the ratio $S_o/S_H$ is 0.245, so that the condition described by using FIG. 4 is also satisfied.

The common electrode 8 and the selection electrode 9 are formed by an etching process. The corner of each of electrodes 8 and 9 are curved, so that the current is prevented from being concentrated upon the corner thereof.

When a voltage is applied across the common electrode 8 and the selection electrode 9, the current flows through the heating resistance layer 7, so that heat is generated by the heating resistance layer 7. In this case, the current density in the special part 16 is less than that in the normal part of the heating resistance layer 7, so that the amount of heat generated from the special area 16 per a unit area is less than the amount of heat generated from the normal area per a unit area.

When the heater operation part 11 having a structure described above was driven, a bubble was generated, grown and disappeared on the heater operation portion 11, as shown in FIG. 6. That is, the bubble 17 which had reached its maximum size was constricted, and disappeared on the special part 16 of the heat operation part 11. In the next heat cycle of the heater operation part 11, the film boiling started to occur on the normal part of the heater operation part 11, so that the the bubble was stably generated on the normal part of the heater operation part 11. The bubble then grew so as to extend to the special part 16.

Generation, growth, constriction, and disappearance of the bubble were stably carried out, repeatedly, on the heater operation part 11. In the above process, the shape and size of the bubble generated on the heater operation part 11 were approximately constant. Even if the small residual bubbles remained on the special part 16 when the bubble 17 disappeared, the small residual bubbles were not the core of the growth of the bubble 17. That is, stable repeated film boiling was carried out on the normal part of the heater operation part 11.

In this case, the size of the liquid droplet jetted through the orifice 2 and the jetting speed thereof were approximately constant, so that the dot image having a high quality was formed on the recording sheet.

Contrastingly, the conventional generation, growth, constriction, and the disappearance of the bubble were repeatedly carried out, as shown in FIG. 7.

In the conventional case indicated in FIG. 7, the small residual bubbles on the heater operation part become the core of the growth of the bubble 17 in the next heat cycle, so that a core film boiling is carried out at random. In a normal case where the the core film boiling is carried out at one position as shown in FIG. 7(*a*), the bubble is stably 10 own. However, in a case where the core film boiling is carried out at a plurality of positions as shown in FIG. 7(*b*) and (*c*), the bubble can not be stably grown. That is, the size of the bubble grown in the liquid and the shape thereof are not constant. Thus, in the conventional case, the size of the liquid droplet and the jetted speed of the liquid droplet vary, so that the quality of the dot image formed on the recording sheet deteriorates.

Figure 8A:
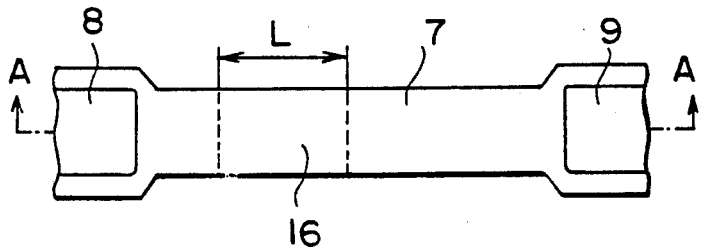
FIGS. 8A and 8B are diagrams illustrating an electricity-heat converter used in a liquid jet recording head according to a second embodiment of the present invention.
Figure 8B:
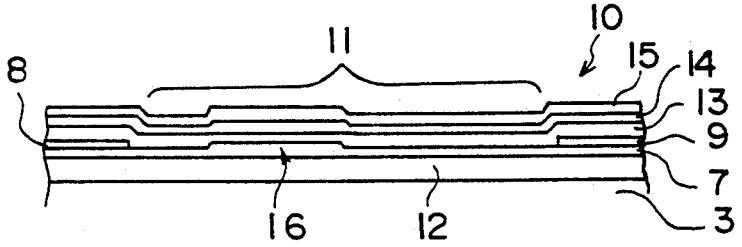

A description will now be given of a second embodiment of the present invention with reference to FIGS. 8A and 8B. In FIGS. 8A and 8B, those parts which are the same as those shown in FIG. 5 are given the same reference numbers.

Referring to FIGS. 8A and 8B, the width of the heating resistance layer 7 between the common electrode 8 and the selection electrode 9 is constant. The thickness of the resistance layer 7 varies so that the thickness in the special part 16 of the heat operation part 11, the special part 16 including the position on which the bubble disappears, is greater than that in the normal part thereof. The heating resistance layer 7 having the thickness which varies is formed by a film forming technique, a photolithographic process, and an etching process.

The heating resistance layer 7 is formed, for example, as follows.

A $Ta_2N$ layer 0.4 μm thick is formed on the heat reserve layer 12 by the sputtering process. A photoresist is coated on the $Ta_2N$ layer and exposed through a mask covering the special part 16. After this, the $Ta_2N$ layer in the normal part of the heat operation part 11 is etched to a thickness of 0.28 μm by the dry etching process. As a result, the heating resistance layer 7 made of $Ta_2N$, in which the thickness thereof in the special part 16 of the heat operation part 11 is 0.4 μm and the thickness in the normal part is 0.28 μm, is formed on the heat reserve layer 12. The length L of the special part 16 of the heat operation part 11 in the direction of flow is set at 30 μm. The other layers of the electricity-heat conversion element 10 are formed in the same manner as those shown in FIG. 5.

In the heating resistance layer 7 having the structure shown in FIGS. 8A and 8B, the current density in the special part 16 is less than that in the normal part. Thus, the bubble is generated, grown, constricted and disappears, as shown in FIG. 6, in the same manner as that shown in FIG. 5, so that the size of the liquid droplet and the jetted speed of the liquid droplet can be constant. Thus, fine dot images can be formed on the recording sheet.

Figure 9A:
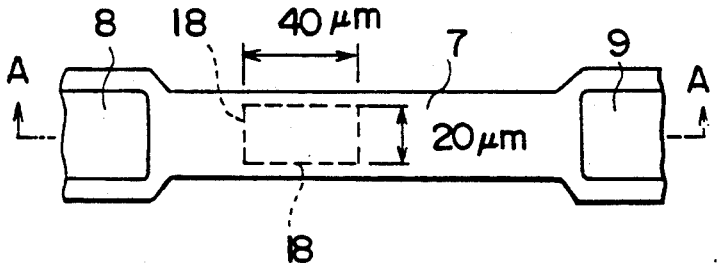
FIGS. 9A and 9B are diagrams illustrating an electricity-heat converter used in a liquid jet recording head according to a third embodiment of the present invention.
Figure 9B:
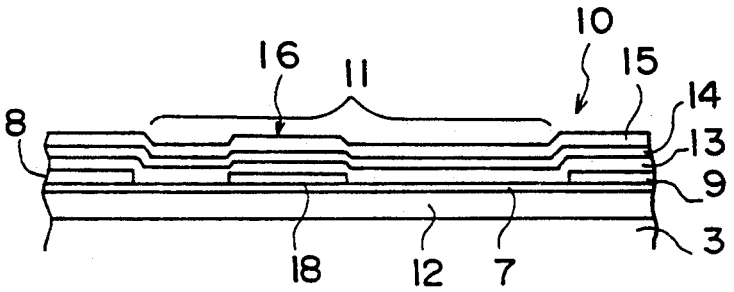

A description will now be given of a third embodiment of the present invention with reference to FIGS. 9A and 9B. In FIGS. 9A and 9B, those parts which are the same as those shown in FIGS. 5A, 5B, 8A and 8B are given the same reference numbers.

Referring to FIGS. 9A and 9B, the width of the heating resistance layer 7 between the common electrode 8 and the selection electrode 9 is constant. A conductive pattern 18 is formed on the resistance layer 7 in the special part 16 of the heat operation part 11, the special part 16 including a position at which the bubble disappears. Due to the conductive pattern 18 in the heating resistance layer 7 the current density in the special part 16 is less than that in the normal part.

The conductive pattern 18 is formed on the heating resistance layer 7 by the sputtering process, the photolithographic process, and the etching process, and has, for example, a thickness of 0.3 μm, a length of 40 um, and a width of 20 um.

In the electricity-heat conversion element 10 having the structure shown in FIGS. 9A and 9B, as the current density in the special part 16 is decreased, the bubble can be generated, grown, constricted and disappears as shown in FIG. 6. Thus, the size of the liquid droplet and the jetted speed of the liquid droplet can be constant, so that fine dot images can be formed on the recording sheet.

The conductive pattern 18 can be formed on a surface of the heating resistance layer 7, which surface faces the heat reserve layer 12.

Figure 10A:
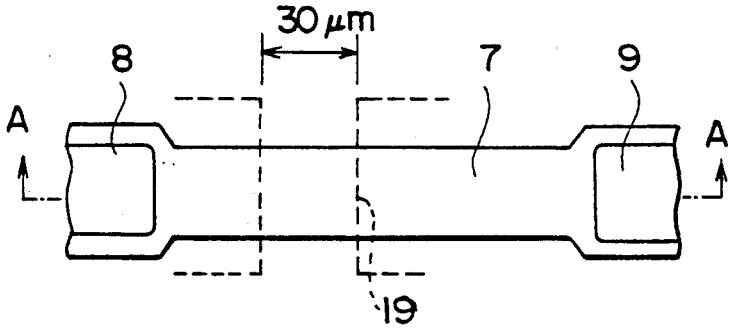
FIGS. 10A and 10B are diagrams illustrating an electricity-heat converter used in a liquid jet recording head according to a fourth embodiment of the present invention.
Figure 10B:
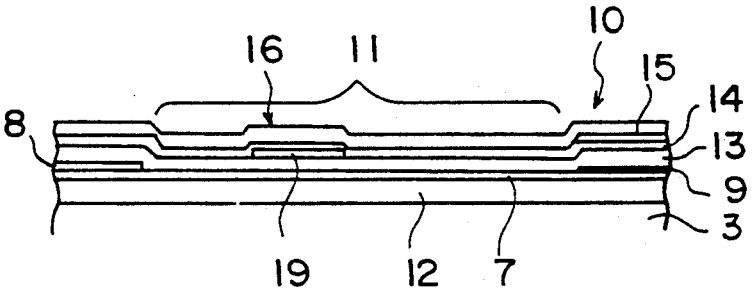

A description will now be given of a fourth embodiment of the present invention with reference to FIGS. 10A and 10B. In FIGS. 10A and 10B, those parts which are the same as those shown in FIGS. 5A, 5B, 8A, 8B, 9A and 9B are given the same reference numbers.

Referring to FIGS. 10A and 10B, the width and thickness of the heating resistance layer 7 between the common electrode 8 and the selection electrode 9 are constant. A radiator member 19 is formed on the first protection layer 13 in the special part 16 of the heat operation part 11, the special part 16 including a position at which the bubble disappears. The radiator member 19 is made, for example, of Al and has a thickness of 0.4 um. The radiator member 19 is put between the first and second protection layers 13 and 14.

The first protection layer 13 is formed by the sputtering of $SiO_2$ to a thickness of 0.5 $\mu$m. The second protection layer 14 is formed by the sputtering of $SiO_2$ to a thickness of 0.7 $\mu$m, which $SiO_2$ is substituted for $Ta_2O_5$ used in the case shown in FIG. 5. The length of the radiator member 19 in the direction of flow of the liquid is 30 um.

In the electricity-heat conversion element 10 having the structure shown in FIGS. 10A and 10B, the heat generated from the heating resistance layer 7 in the special part 16 is transmitted and diffused to the radiator member 19. Thus, the amount of heat transmitted from the special part 16 of the heat operation part 11 to the liquid is less than the amount of heat transmitted from the normal part of the heat operation part 11 to the liquid. As a result, the bubble can be generated, grown, constricted and disappears as shown in FIG. 6, so that the size of the liquid droplet and the jetted speed of the liquid droplet can be constant. That is, fine dot images can be formed on the recording sheet.

The radiator member 19 can be provided between the first protection layer 13 and the heating resistance layer 7 so as to be in contact with the heating resistance layer 7. Further, the radiator member can be provided between the heating resistance layer 7 and the heat reserve layer 12. In a case where the radiator member is in contact with the heating resistance layer 7, the special part 16 of the heat operation part 11 can be effectively cooled. In addition, in a case where the radiator member formed of a conductive material is in contact with the heating resistance layer 7, both the current density in the special part 16 and the amount of heat transmitted from the special art 16 to the liquid can be decreased. Thus, the special part 16 can be more effectively cooled.

Figure 11A:
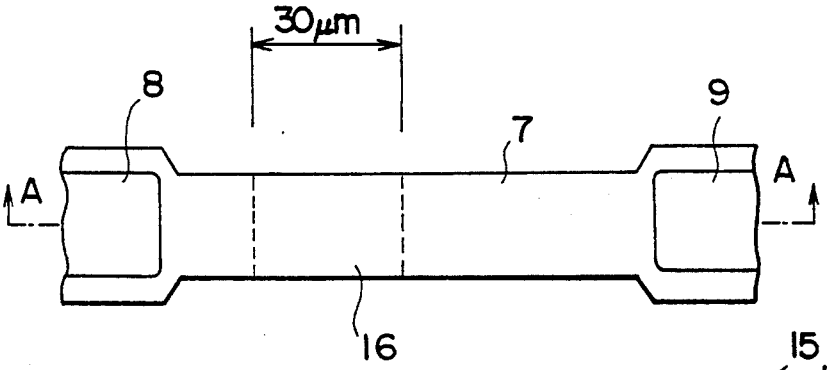
FIGS. 11A and 11BB are diagrams illustrating an electricity-heat converter used in a liquid jet recording head according to a fifth embodiment of the present invention.
Figure 11B:
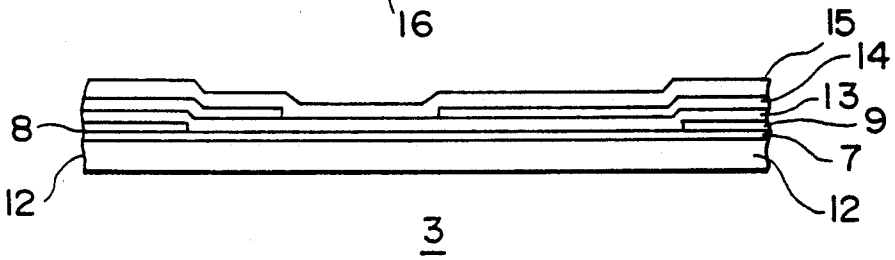

A description will now be given of a fifth embodiment of the present invention with reference to FIGS. 11A and 11B. In FIGS. 11A and 11B, those parts which are the same as those shown in FIGS. 5A, 5B, 8A and 8B, 9A and 9B, 10A and 10B are given the same reference numbers.

Referring to FIGS. 11A and 11B, a total thickness of the protection layers 13, 14 and 15 in the special part 16 of the heat operation part 11 is less than that in the normal part of the heat operation part 11. A $SiO_2$ film having a thickness of 0.4 $\mu$m is formed, as the first protection layer 13, by the sputtering process. Then a $Si_3N_4$ film having a thickness of 0.9 $\mu$m is formed on the first protection layer 13, as the second protection layer 14, by the sputtering process. The photolithographic process is then executed, by which the second protection layer 14 in the special part 16 is exposed and only the normal part is covered by a photoresist. The plasma-dry-etching process is then executed, so that only the $Si_3N_4$ (the second protection layer 14) in the special part 16 is removed. As a result, the $SiO_2$ film (the first layer 13) is exposed in the special part 16. After the unnecessary photoresist is removed, the $SiO_2$ film having a thickness of 1 $\mu$m is formed, as the third protection layer 15, by the sputtering process.

As the protection layers 13, 14 and 15 in the special part 16 are thinner than those in the normal part, the amount of heat reserved in the special part 16 is less than the amount of heat reserved in the normal part when the bubble disappears. That is, the temperature in the special part 16 is less than that in the normal part when the bubble disappears. Thus, the bubble can be stably generated, grown, constricted and disappears as shown in FIG. 6.

A description will now be given, with reference to FIGS. 12 through 15, of another example of a liquid jet recording head having a plurality of electricity-heat conversion elements, each having one of the structures described above.

Figure 12:
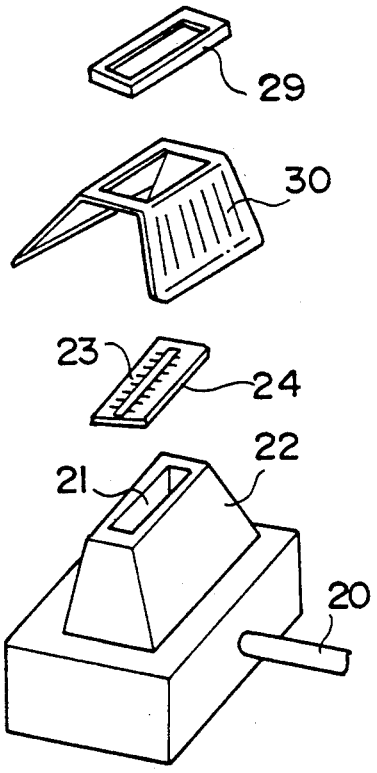
FIGS. 12, 13, 14 and 15 are diagrams illustrating another structure of a liquid jet recording head.
Figure 13:
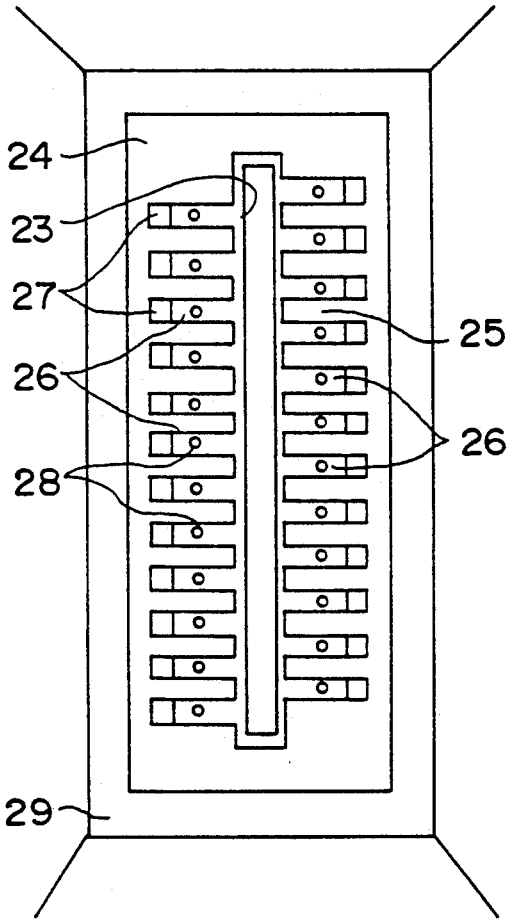
Figure 14:
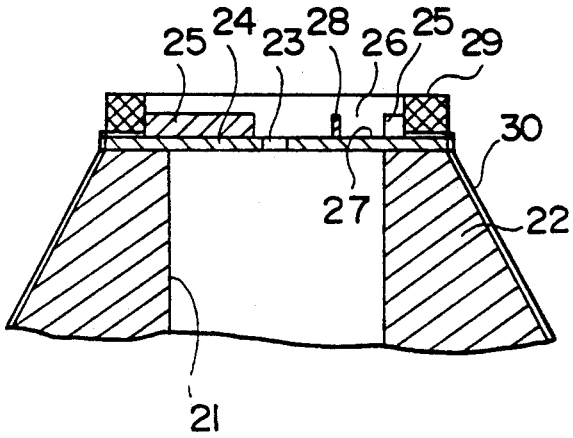

In this liquid jet recording head, as shown in FIG. 12, a trapezoid-shaped manifold 22 having a liquid supplying chamber 21 is connected to a pipe 20, so that the liquid used for the printing is supplied to the manifold 22 via the pipe 20. A base plate 24 having a slit 23 is mounted on the top of the manifold 22 so that the slit 23 of the base plate 24 faces the liquid supplying chamber 21 of the manifold 22. A plurality of walls 25 are formed on the base plate 24 at both sides of the slit 23 so as to be arranged like the teeth of a comb. Thus the walls 25 are arranged at both sides of the slit 23 so as to form a zigzag pattern. A flow path 26 of a plurality thereof is formed between each adjacent pair of the walls 25. The flow paths 26 are connected to the slit 23. A heater element 27 of a plurality thereof is formed on the base plate 24 at an end of each of the flow paths 26 away from the slit 23. Thus, the heater elements 27 are arranged at both sides of the slit 23 so as to form a zigzag pattern, as shown in FIG. 13. A pole 28 of a plurality thereof operating as a resistance to the liquid is formed in each of the flow paths 26. Each of the poles 28 has the almost the same height as each of the walls 25, as shown in FIG. 14. A conductive lead 30 is mounted on the manifold 22. The conductive lead 30 is fixed, by a frame 29, on the periphery of the top of the manifold 22.

Figure 15:
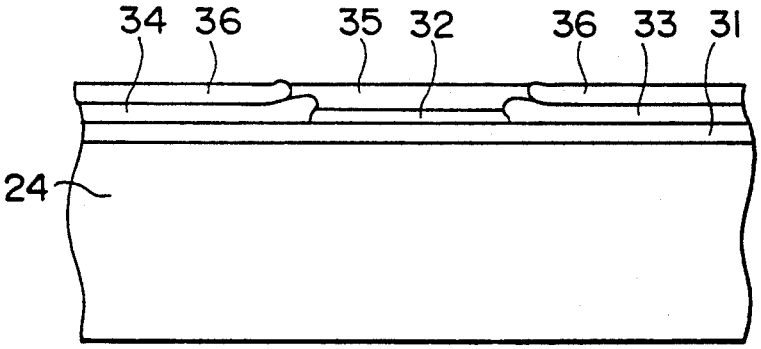

A stacked structure including a heater element 27 of a plurality thereof is shown in FIG. 15. Referring to FIG. 15, a heat reserve layer 31 is formed on the base plate 24. A heating resistance layer 32, and a pair of electrodes 33 and 34 connected to ends of the heating resistance layer 32 are formed on the heat reserve layer 31. The heating resistance layer 32 is covered by a protection layer 35, and the electrodes 33 and 34 are covered by electrode protection layers 36. Lead wires are bonded on the electrodes 33 and 34 and the conductive lead 30 described above, so that the heating resistance layer 32 is electrically connected to the conductive lead 30. Image information signal is supplied to the heating resistance layer 32 via the conductive lead 30.

The liquid (ink) flowing into the liquid supplying chamber 21 via the pipe 20 is supplied to each of the flow paths 26 via the slit 23, in accordance with the capillarity. In a case where each of the flow paths 26 is not completely filled with the liquid, if the height of a liquid tank (not shown) connected to an end of the pipe 20 is controlled, the liquid can fill each of the flow paths 26 based on the difference between water heads in the liquid tank and those in the liquid jet recording head. In a normal state where the liquid fills each of the flow paths 26 so that the heater element 27 is covered by the liquid, when an electrical current is supplied to the heating resistance layer 32 in accordance with the image information, a bubble is generated in the liquid by heat of the heating resistance layer 32. Then a liquid droplet is jetted by a propulsion force of the bubble in a direction perpendicular to the surface of the heater element 27.

A description will now be given, with reference to FIG. 16, of the principle of the jetting of the liquid droplet. FIG. 16 shows the heater element 27 and a surrounding part thereof. In FIG. 16, the electrodes and the like are omitted for the sake of simplicity.

Figure 16A:
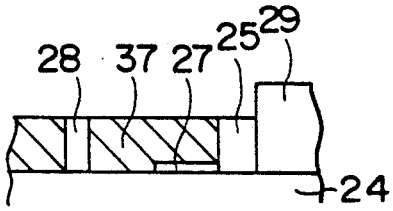
FIGS. 16A-16G are diagrams illustrating a process for jetting a liquid droplet.
Figure 16E:
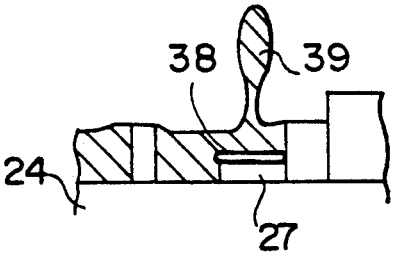
Figure 16B:
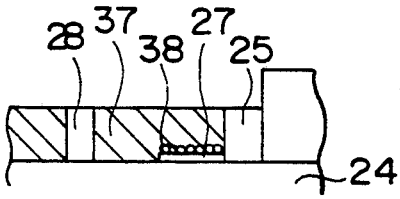
Figure 16F:
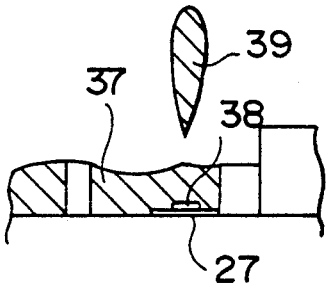
Figure 16C:
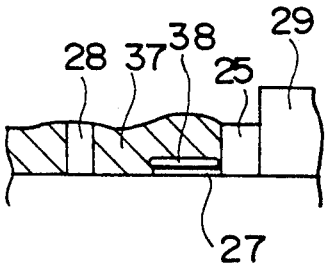
Figure 16D:
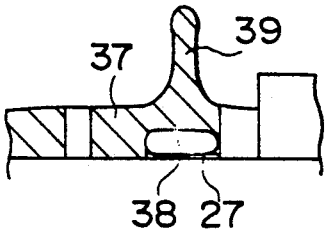
Figure 16G:
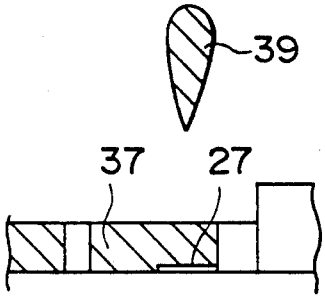

FIG. 16A shows a normal state. In this normal state, each of the flow paths 26 is filled with a liquid 37 so that the heater element 27 is covered by the liquid 37. When the heater element 27 is activated, the surface temperature of the heater element 27 increases. The liquid is then heated by the heater element 27 so that the liquid 37 is boiled. At this time, small bubbles are generated in the liquid 37 on the heater element 27, as shown in FIG. 16B. When the liquid 37 on the heater element 27 is further instantly heated, the liquid 37 on the heater element 27 is vaporized, so that the boiling film is formed in the liquid 37, as shown in FIG. 16C. In a state where a bubble 38 is grown in the liquid 37, as shown in FIG. 16C, the surface temperature of the heater element 27 falls within a range of 300°-500° C. That is, the film boiling occurs. In addition, the surface of the liquid 37 on the heater element 27 is swollen, as shown in FIG. 16C, by a propulsion force of the bubble 38. When the bubble 38 is grown to a maximum size as shown in FIG. 16D, a liquid column 39 is projected from the surface of the liquid 37 on the heater element 27. The bubble 38 normally reaches the maximum size 30-50 usec. from the time the heater element 27 was supplied with the pulse signal. When the bubble 38 reaches the maximum size, the heater element 27 is inactivated. That is, when the bubble reaches the maximum size, the surface temperature of the heater element 27 decreases. When the heater element 27 is inactivate, the liquid on the heater element 27 is cooled, so that the bubble 38 is constricted as shown in FIG. 16E. A front end of the liquid column 39 is continuously jetted at a speed first obtained. A rear end of the liquid column 39 is pulled toward the liquid 37 due to the constriction of the bubble 38. As a result, the rear end part of the liquid column 39 is constricted as shown in FIG. 16E. When the bubble 38 is further constricted as shown in FIG. 16F, the liquid 37 is brought into contact with the surface of the heater element 27, so that the heater element is instantly cooled. Then the rear end of the column 39 is separated from the surface of the liquid 38 on the heater element 27, so that the liquid droplet 39 is jetted toward the recording sheet (not shown) at a speed within a range of 2-10 m/sec., as shown in FIG. 16F. After the liquid droplet 39 is jetted, the liquid 37 returns to the normal state as shown in FIG. 16G which is the same as that shown in FIG. 16A.

In the liquid jet recording head shown in FIGS. 12 through 15, the heater element 27 has the special part including a position at which the bubble disappears. In the special part of the heater element 27, the width or the thickness of the heating resistance layer 32 is greater than that in the normal part of the heater element 27, as shown in FIGS. 5A and 5B or 8A and 8B. In addition, the conductive pattern or the radiator member can be provided in the special part of the heater element 27, as shown in FIGS. 9A and 9B or 10. Thus, the liquid droplet 39 can be stably jetted, so that fine dot images can be formed on the recording sheet.

Figure 17:
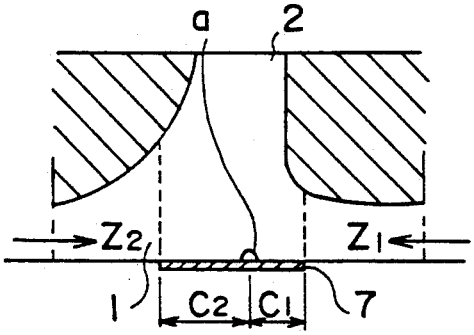
FIG. 17 is a cross sectional view illustrating another structure of a liquid jet recording head according to the present invention.

The present invention can be applied to the liquid jet recording head having a structure shown in FIG. 17. In FIG. 17, a position at which the bubble disappears is indicated by a. In this case, a special part including the position a is set on the heating resistance layer 7. In the special part, the width of the heating resistance layer 7 is increased, the thickness of the heating resistance layer 7 is increased, a conductive pattern is formed on the heating resistance layer 7, or the radiator member is provided on the heating resistance, as has been described above.

The present invention can also applied to a liquid jet recording head disclosed in Japanese Patent Application No. 1-192357, in which a recording head the size of the liquid droplet is controlled by controlling the size of the bubble, so that a gradational image can be formed on the recording sheet.

Figure 18A:
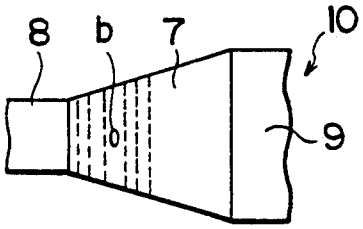
FIGS. 18A, 18B and 18C are diagrams illustrating other heating resistance layers capable of being used in a liquid jet recording head according to the present invention.
Figure 18B:
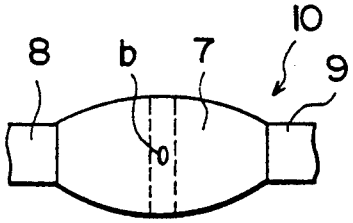
Figure 18C:
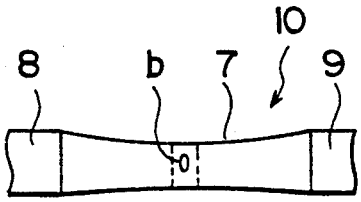

The present invention can also be applied to a liquid jet recording head disclosed in Japanese Patent Publication No. 59-31943. An essential part of this type of liquid jet recording head is shown in FIGS. 18A, 18B and 18C. In FIGS. 18A, 18B and 18C, the bubble disappears at a point b on the heating resistance layer 7. The special part having the same structure as that shown in FIGS. 5A and 5B, 8A and 8B, 9A and 9B, or 10A and 10B includes the point b.

The present invention can be applied to a liquid jet recording head serially scanning the recording sheet and a liquid jet recording head of a full-multi-type having a width corresponding to that of the recording sheet.

The present invention is not limited to the aforementioned embodiments, and variations and modifications may be made without departing from the scope of the claimed invention.

What is claimed is:

1. A liquid jet recording head comprising:

liquid storage means for storing a liquid used for recording images; and heater means, coupled to said liquid storage means, for generating heat, generation of a bubble and disappearance thereof being alternately carried out in the liquid stored in said liquid storage means when said heater means is activated and inactivated alternately, and a liquid droplet being jetted from said liquid storage means by a propulsion force of the bubble, said heater means comprising:

a heat reserve layer;

a resistance layer formed on said heat reserve layer;

electrodes electrically connected to said resistance layer, said resistance layer generating heat when an electrical current is supplied to said resistance layer via said electrodes; and a protection layer stacked on said resistance layer, the heat generated by said resistance layer being transmitted to the liquid via said protection layer;

wherein said heater means has a special part in which a radiator member is provided at a position on said protection layer, said position corresponding to a disappearance position where the bubble disappears on said heater means, so that the special part is cooled by said radiator member, said disappearance position being obtained based on the following relationship;

$$C1/C2 = W2/W1$$

where C1 is a distance between a front end of said heater means and said disappearance position, C2 is a distance between a rear end of said heater means and said disappearance position, W1 is a volume of a space lying between a first end of said liquid storage means and the front end of said heater means, and W2 is a volume of a space lying between a second end of said liquid storage means and the rear end of said heater means.

2. A liquid jet recording head as claimed in claim 1, wherein said heater means is activated so that a difference between a first temperature and a second temperature falls within a rage of 25°-95° C., said first temperature being defined as a maximum of a surface temperature of said special part, and said second temperature being defined as a maximum of a surface temperature of said normal part of said heater means.

3. A liquid jet recording head as claimed in claim 1, wherein the liquid droplet is jetted from said liquid storage means in a direction approximately parallel to a surface of said protection layer of said heater means.

4. A liquid jet recording head as claimed in claim 1, wherein the liquid droplet is jetted from said liquid storage means in a direction approximately perpendicular to a surface of said protection layer of said heater means.

* * * * *